US008830151B2

(12) United States Patent
Kim et al.

(10) Patent No.: US 8,830,151 B2
(45) Date of Patent: Sep. 9, 2014

(54) BACKLIGHT UNIT AND LIQUID CRYSTAL DISPLAY INCLUDING THE SAME

(75) Inventors: Dong Pyo Kim, Daejeon (KR); Kyu Ha Baek, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 295 days.

(21) Appl. No.: 13/368,287

(22) Filed: Feb. 7, 2012

(65) Prior Publication Data

US 2012/0218174 A1 Aug. 30, 2012

(30) Foreign Application Priority Data

Feb. 25, 2011 (KR) ..... 10-2011-0016817
Oct. 11, 2011 (KR) ..... 10-2011-0103495

(51) Int. Cl.
*G09G 3/36* (2006.01)

(52) U.S. Cl.
USPC ..... 345/88; 349/71

(58) Field of Classification Search
CPC ..... G09G 3/3607; G09G 3/3611; G02F 1/00; G02F 1/1335
USPC ..... 345/88
See application file for complete search history.

(56) References Cited

U.S. PATENT DOCUMENTS

| | | | | |
|---|---|---|---|---|
| 5,760,858 | A | 6/1998 | Hodson et al. | |
| 7,746,423 | B2 * | 6/2010 | Im et al. | 349/71 |
| 2002/0167624 | A1 * | 11/2002 | Paolini et al. | 349/61 |
| 2007/0146584 | A1 * | 6/2007 | Wang et al. | 349/106 |
| 2008/0158480 | A1 * | 7/2008 | Ii et al. | 349/71 |
| 2008/0231173 | A1 * | 9/2008 | Park | 313/503 |
| 2009/0141381 | A1 * | 6/2009 | Itou et al. | 359/891 |
| 2009/0262280 | A1 | 10/2009 | Kwon | |

FOREIGN PATENT DOCUMENTS

| | | | |
|---|---|---|---|
| KR | 1020070020725 | A | 2/2007 |
| KR | 1020070053931 | A | 5/2007 |
| KR | 1020090110217 | A | 10/2009 |
| KR | 1020100018433 | A | 2/2010 |

* cited by examiner

*Primary Examiner* — Lixi C Simpson

(57) ABSTRACT

Provided are a backlight unit capable of improving light efficiency and acquiring a high-luminance image by implementing a color image without using a color filter having the large light loss and a liquid crystal display including the same. The backlight unit includes: a white light source generating white light, a light guide plate into which the white light is inputted, a blue phosphor sheet formed above the light guide plate and transmitting the white light, and a multi-color phosphor sheet formed on the same plane above the blue phosphor sheet and including a plurality of red phosphor layers, green phosphor layers, and transparent layers which transmit the light transmitted through the blue phosphor sheet.

12 Claims, 4 Drawing Sheets

BACKLIGHT UNIT AND LIQUID CRYSTAL DISPLAY INCLUDING THE SAME

CROSS-REFERENCE TO RELATED APPLICATIONS

This application is based on and claims priority from Korean Patent Application No. 10-2011-0016817, filed on Feb. 25, 2011, and Korean Patent Application No. 10-2011-0103495, filed on Oct. 11, 2011, with the Korean Intellectual Property Office, the disclosure of which is incorporated herein in its entirety by reference.

TECHNICAL FIELD

The present disclosure relates to a backlight unit generating red, green, and blue lights and a liquid crystal display displaying high-luminance color images using the same.

BACKGROUND

A liquid crystal display (LCD) includes a thin film transistor (hereinafter, referred to as TFT) array for controlling arrangement of a liquid crystal, a liquid crystal panel including a color filter for color implementation, and a backlight unit for irradiating light to the liquid crystal panel. A minimum unit for color implementation of the liquid crystal display is a pixel and the pixel includes red R, green G, and blue B subpixels. (In some cases, the pixel further includes yellow Y or white W subpixel.)

In general, the light generated in the backlight unit is white light including all wavelengths of the red, green, and blue lights. When the white light transmits the color filter of the liquid crystal panel, only the wavelength corresponding to the color of each color filter is transmitted and the wavelengths of the rest of two colors are absorbed. Accordingly, a known liquid crystal display uses the color filter, such that use efficiency of light is largely deteriorated.

FIG. 1 is a configuration diagram of a liquid crystal display in the related art.

Referring to FIG. 1, the liquid crystal display in the related art includes a backlight unit 10 and a liquid crystal panel 20 and the liquid crystal panel 20 includes a TFT array panel including a TFT (not shown) for controlling transmittance of light through the alignment control of a liquid crystal layer 207 and a pixel electrode 205 and red, green, and blue color filters 215*a*, 215*b*, and 215*c* for color implementation.

The TFT array panel includes a TFT active element (not shown), a pixel electrode 205 controlling the transmittance of light by the alignment control of the liquid crystal in areas of the red, green, and blue color filters 215*a*, 215*b*, and 215*c*, and a lower glass substrate 203. Red, green, and blue of subpixel areas are determined by a gate electrode line (not shown) and a data electrode line (not shown) of the TFT array panel.

A color filter layer 215 is a configuration of the color image implementation of the liquid crystal panel 20 and forms a substrate together with an upper glass substrate 211, a common electrode 209, and a black matrix 217 preventing a mixed color due to light leakage. A lower polarizer 201 polarizing light irradiated from the backlight unit 10 is disposed at the lower surface of the liquid crystal panel 20 and an upper polarizer 213 polarizing the light transmitting the color filter layer 215 is disposed at the upper surface of the liquid crystal panel 20. The color implementation of the liquid crystal display is performed by combining the red, green, and white light L0 inputted from the backlight unit 10 to the lower portion of the liquid crystal panel 20 includes all the wavelengths of red, green, blue lights and the transmittance of light is changed according to the arrangement direction of the controlled liquid crystal layer 207 in the subpixel corresponding to each color to control the color of each pixel.

Meanwhile, since the liquid crystal display is a device of displaying an image by controlling the transmittance of light, the backlight unit 10 for irradiating the white light L0 to the liquid crystal panel 20 is disposed at the bottom of the liquid crystal panel 20. The backlight unit 10 includes a light source (not shown) generating the light, a light guide plate 101 with a reflective plate at the bottom thereof, a diffuser sheet 103, and a prism sheet 105. The light generated from the light source is collected in the light guide plate 101 to pass through the diffuser sheet 103 and the prism sheet 105 which are an optical sheet and then, be irradiated to the liquid crystal panel 20 (L0).

Herein, while the white light generated from the light source of the backlight unit 10 is irradiated to the liquid crystal panel 20 to pass through an lower polarizer 201, a TFT array substrate, a liquid crystal layer, color filters 215*a*, 215*b*, and 215*c*, and an upper polarizer 213, and the like, the white light is almost absorbed or blocked by the black matrix 217. Accordingly, finally, a light amount emitted from the surface of the liquid crystal display is no more than 10% of the light amount of an initially inputted light source to have very low light efficiency and consume high power due to the low light efficiency. Particularly, since the light transmitted through the color filters 215*a*, 215*b*, and 215*c* is about 30% and 70% is absorbed and dissipated, the color filter is a component having the largest light loss in the liquid crystal display.

Recently, a demand for low power for high-quality, thin film, large-size, and energy reduction of the liquid crystal display is increasing and particularly, in order to implement a 3D image, when 3D glasses are used, since the luminance of the 3D image is lower than a 2D image by about a tenth, improvement in the light efficiency of the liquid crystal display is more urgently required.

SUMMARY

The present disclosure has been made in an effort to provide a backlight unit having advantages of improving light efficiency and acquiring a high-luminance image by implementing a color image without using a color filter having large light loss and a liquid crystal display including the same.

An exemplary embodiment of the present disclosure provides a liquid crystal display, including: a backlight unit generating red light, green light, and blue light; and a liquid crystal panel displaying color images by controlling the light amount of the red light, the green light, and the blue light generated in the backlight unit.

Red subpixels, green subpixels, and blue subpixels corresponding to the areas where the red light, the green light, and the blue light generated in the backlight unit are inputted may be formed in the liquid crystal panel.

The liquid crystal panel may include an upper glass substrate, a lower glass substrate, and a liquid crystal layer formed between the upper and lower glass substrates and a color filter layer may not be formed on the upper glass substrate.

Another exemplary embodiment of the present disclosure provides a backlight unit, including: a white light source generating white light; a light guide plate into which the white light is inputted; a blue phosphor sheet formed above the light guide plate and transmitting the white light; and a multi-color phosphor sheet formed on the same plane above the blue phosphor sheet and including a plurality of red phosphor layers, green phosphor layers, and transparent layers which transmit the light transmitted through the blue phosphor sheet.

The backlight unit may further include a reflective layer formed at the edge regions of the plurality of red phosphor layers, green phosphor layers, and transparent layers, in which the reflective layer may be formed on the same plane as the multi-color phosphor sheet or between the blue phosphor sheet and the multi-color phosphor sheet.

Yet another exemplary embodiment of the present disclosure provides a backlight unit including: a blue light source generating blue light; a light guide plate into which the blue light is inputted; and a multi-color phosphor sheet formed on the same plane above the light guide plate and including a plurality of red phosphor layers, green phosphor layers, and transparent layers which transmit the blue light.

The backlight unit may further include a reflective layer formed at the edge regions of the plurality of red phosphor layers, green phosphor layers, and transparent layers, in which the reflective layer may be formed on the same plane as the multi-color phosphor sheet or between the light guide plate and the multi-color phosphor sheet.

According to the exemplary embodiments of the present disclosure, since red, green, and blue lights are directly generated in the backlight unit to be irradiated to the liquid crystal display and the light amount of each color is controlled by controlling the arrangement of the liquid crystal layer so as to implement the color image without the color filter having large light loss, it is possible to largely improve the light efficiency of the liquid crystal display.

The brightness of a blue wavelength is improved by using a blue light source or blue light transmitting a blue phosphor sheet in the backlight unit, such that it is possible to acquire high color reproduction rate.

The light is collected in a subpixel area through a reflective layer formed at an edge region of a phosphor layer using a micro-pattern, such that it is possible to increase the amount of light transmitting the subpixel and improve the luminance The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof The illustrative embodiments described in the detailed description, drawing, and claims are not meant to be limiting. Other embodiments may be utilized, and other changes may be made, without departing from the spirit or scope of the subject matter presented here.

Figure 2:
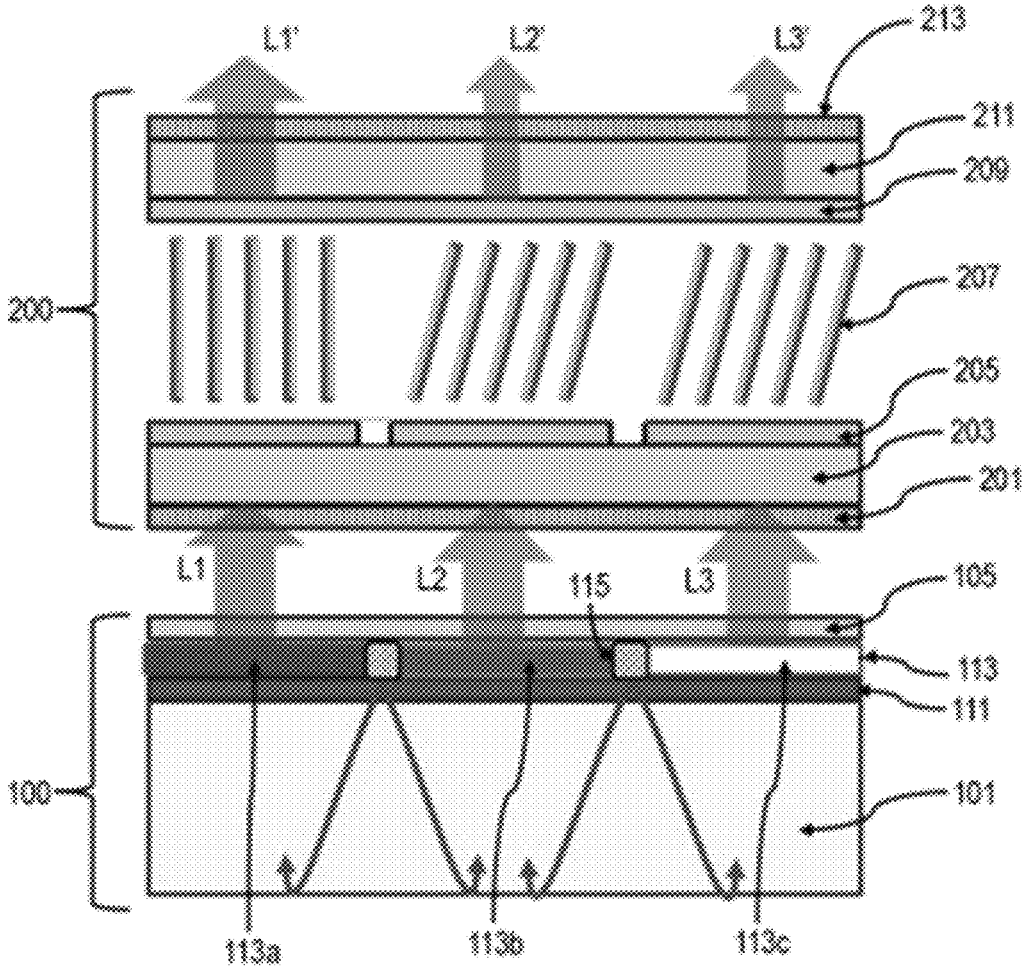
FIG. 2 is a configuration diagram of a liquid crystal display according to an exemplary embodiment of the present disclosure.

FIG. 2 is a configuration diagram of a liquid crystal display according to an exemplary embodiment of the present disclosure.

Referring to FIG. 2, a liquid crystal display according to an exemplary embodiment of the present disclosure includes a backlight unit 100 generating red light L1, green light L2, and blue light L3 and a liquid crystal panel 200 displaying a color image by controlling the amount of light of the red light L1, the green light L2, and the blue light L3 generated in the backlight unit 100.

The backlight unit 100 includes a white light source (not shown) generating white light, a light guide plate 101 into which the white light is inputted, a blue phosphor sheet 111 formed above the light guide plate 101 and transmitting the white light, and a multi-color phosphor sheet 113 formed on the same plane above the blue phosphor sheet 111 and including a plurality of red phosphor layers 113*a*, green phosphor layers 113*b*, and transparent layers 113*c* which transmit the light transmitted through the blue phosphor sheet 111 again.

The liquid crystal panel 200 includes red subpixels, green subpixels, and blue subpixels corresponding to the areas into which the red light L1, the green light L2, and the blue light L3 generated in the backlight unit 100 are inputted.

In the exemplary embodiment, the white light emitted from a light source of the backlight unit 100 transmits the blue phosphor sheet 111 to generate the blue light and forms the red phosphor layers 113*a*, the green phosphor layers 113*b*, and the transparent layers 113*c* generating the red light L1, the green light L2, and the blue light L3 thereabove by using a micro-pattern and a transparent micro-pattern. The generated red light L1, green light L2, and blue light L3 are vertically and directly inputted to the red, green, and blue subpixels of the liquid crystal panel 200 and the light amount of red light L1', green light L2', and blue light L3' emitted from the liquid crystal panel 200 is adjusted by controlling the liquid crystal arrangement of the subpixels, such that the color image is implemented without a color filter.

The micro-pattern forming the blue phosphor sheet 111 and the multi-color phosphor sheet 113 may include all pixel patterns forming a known color substrate such as a stripe, a mosaic, a delta, and the like and may be fabricated at the bottom of a prism substrate or above a diffuser sheet, or at a single sheet. In the case of the multi-color phosphor sheet 113, red and green phosphors are coated on a sheet area corresponding to each color and the phosphors are not coated or a transparent material is filled in the blue area. As described above, when the blue light is firstly used by using the blue phosphor sheet 111, the blue phosphor is not required, such that the process may be simplified and the cost may be reduced.

The backlight unit 100 may further include a reflective layer 115 formed at the edge areas of the red phosphor layers 113*a*, the green phosphor layers 113*b*, and the transparent layers 113*c*. As a result, while light irradiated from the light guide plate 101 to the reflective layer 115 is not transmitted and reflected to the bottom of the light guide plate 101 again, a light path is changed, such that the light may be collected to a transmitting area of the liquid crystal panel 200, that is, the subpixels of each color and a mixed color of the adjacent pixels may be prevented. The reflective layer 115 may have unevenness or grid patterns of nano-intervals there below and the unevenness or nano patterns may be formed by various methods such as a photolithography method, an imprinting method, and the like.

The light source of the backlight unit 100 may use a cold cathode fluorescent lamp, an OLED, an LED, a surface light source, and the like and the light guide plate 101 may include various forms capable of forming the surface light source. The phosphor coated on the phosphor sheets 111 and 113 may use oxide, nitride, and sulfide-based phosphors, a quantum dot phosphor, a hybrid phosphor, and the like and may further use a phosphor capable of representing various colors of yellow, purple, orange, and the like in addition to red, green, and blue. The reflective layer 115 may use a conductive material not transmitting visible light such as aluminum (Al), copper (Cu), gold (Au), silver (Ag), chromium (Cr), tungsten (W), nickel (Ni), titanium (Ti), tantalum (Ta), molybdenum (Mo), neodymium (Nd) and an alloy thereof and a carbon-based conductor such as carbon nanotube and graphene.

Figure 1:
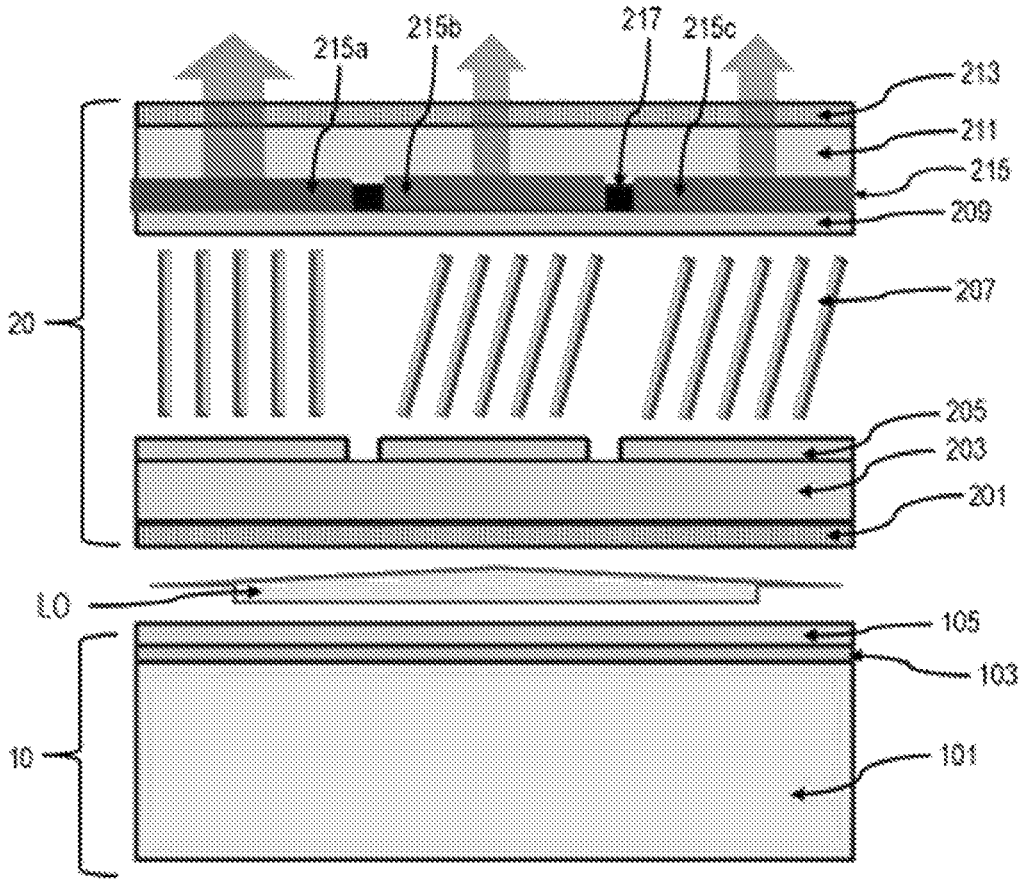
FIG. 1 is a configuration diagram of a liquid crystal display in the related art.

The liquid crystal panel 200 includes a lower polarizer 201, a lower glass substrate 203, a pixel electrode 205, a liquid crystal layer 207, a common electrode 209, an upper glass substrate 211, and an upper polarizer 213. Red subpixels, green subpixels, and blue subpixels corresponding to the areas into which the red light L1, the green light L2, and the blue light L3 generated in the backlight unit 100 are inputted are formed in the liquid crystal panel 200. A known color filter layer 215 of FIG. 1 is not formed.

Each subpixel area is divided by a gate electrode line and a data electrode line of a TFT array substrate (not shown) and the liquid crystal layer 207 is arranged by voltages applied to the common electrode 209 and the pixel electrode 205 which are disposed above and below of the liquid crystal layer 207. The transmittance of the red light L1, the green light L2, and the blue light L3 irradiated from the backlight unit 100 is controlled according to the arrangement of the liquid crystal layer 207, thereby implementing the color image without the color filter.

Figure 3:
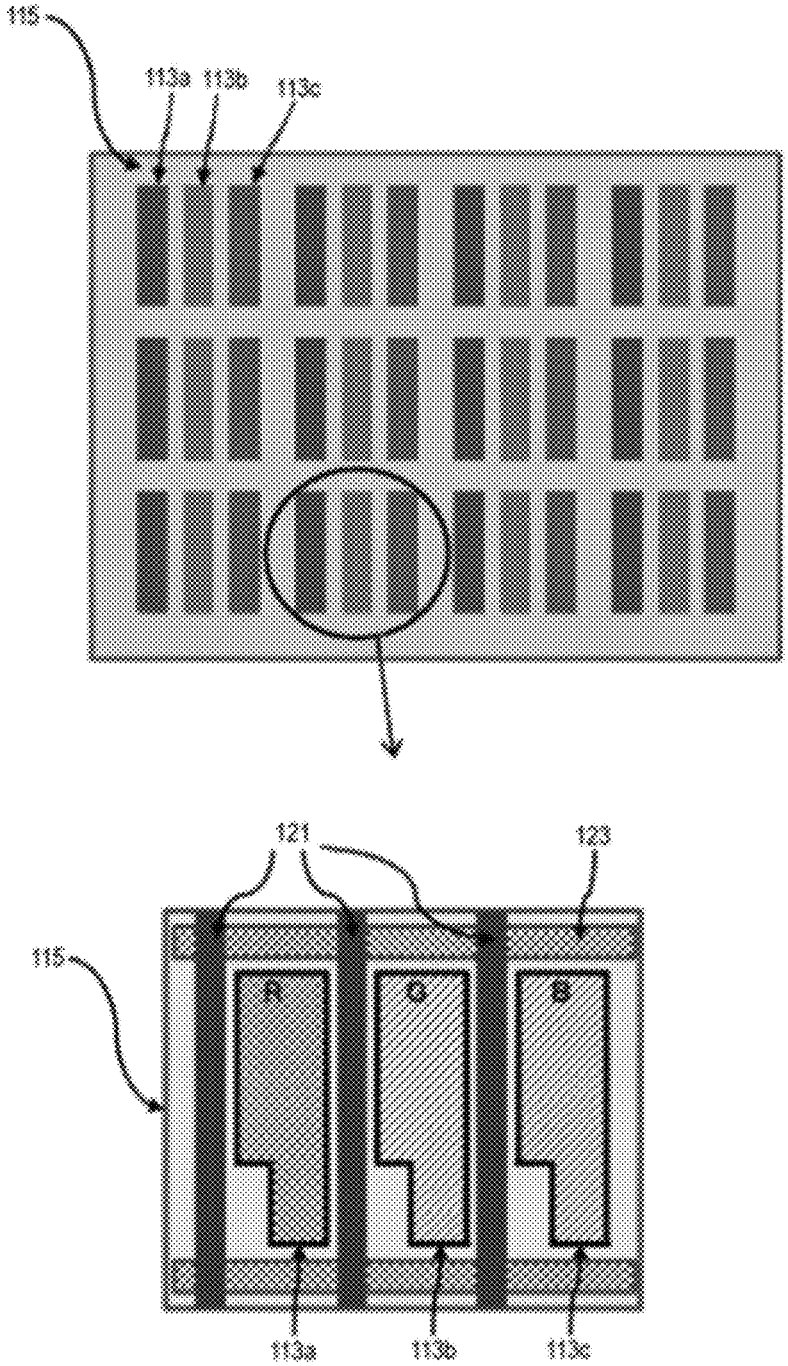
FIG. 3 is a plan view showing a multi-color phosphor sheet and a reflective layer of a backlight unit of FIG. 2.

FIG. 3 is a plan view showing a multi-color phosphor sheet 113 and a reflective layer 115 of a backlight unit 100 of FIG. 2.

As shown in FIG. 3, a red phosphor layer 113*a*, a green phosphor layer 113*b*, and a blue phosphor layer 113*c* configure one set and form one pixel area, and a plurality of pixel areas are regularly arranged.

Referring to a part enlarging one pixel area, the red, green, and blue subpixel areas are determined by a data electrode line 121 and a gate electrode line 123 of the TFT array substrate. The reflective layer 115 is formed in the area other than the subpixel areas and the light, which is irradiated in a direction in which the data electrode line 121 and the gate electrode line 123 are disposed from the backlight unit 100, is reflected to be collected in the subpixel area, such that the light amount transmitting the subpixels may increase and the luminance may be improved.

Figure 4:
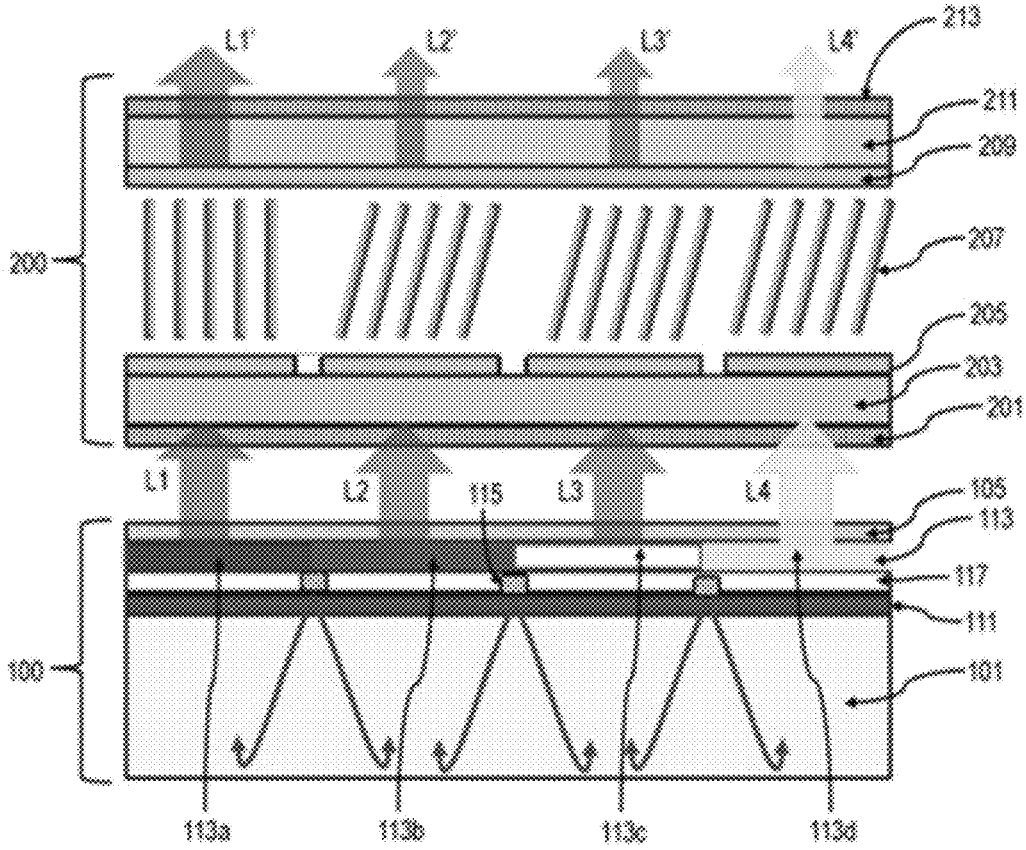
FIG. 4 is a configuration diagram of a liquid crystal display according to another exemplary embodiment of the present disclosure.

FIG. 4 is a configuration diagram of a liquid crystal display according to another exemplary embodiment of the present disclosure.

Referring to FIG. 4, a liquid crystal display according to another exemplary embodiment of the present disclosure may further include a yellow phosphor layer 113*d* generating yellow light L4 in the multi-color phosphor sheet 113 in addition to the configuration of FIG. 2 and a yellow subpixel in an area into which the yellow light L4 is inputted may be further formed in a liquid crystal panel 200.

The reflective layer 115 formed at the edge regions of the red phosphor layer 113*a*, the green phosphor layer 113*b*, the transparent layer 113*c*, and the yellow phosphor layer 113*d* is not formed on the same plane as the multi-color phosphor sheet 113 and may be formed as one separate sheet 117 between the blue phosphor sheet 111 and the multi-color phosphor sheet 113. As described above, the multi-color phosphor sheet 113 and the reflective layer sheet 117 are fabricated by one separate sheet, such that a manufacturing process of the backlight unit 100 can be simplified.

Meanwhile, in FIGS. 2 to 4, the present disclosure is described by assuming that the light source of the backlight unit 100 is the white light source, but the present disclosure may use the blue light source generating blue light instead of the white light source as a light source. In this case, the blue phosphor sheet 111 shown in FIGS. 2 and 4 is not required and the multi-color phosphor sheet 113 and the reflective layer 115 are formed on the same plane directly on the light guide plate 101 or the reflective layer 115 is formed above the light guide plate 101 as the separate sheet 117 as shown in FIG. 4, and then, the multi-color phosphor sheet 113 may be formed thereon.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A backlight unit, comprising:

a white light source generating white light;

a light guide plate into which the white light is inputted;

a blue phosphor sheet formed above the light guide plate and to which the white light is transmitted; and a multi-color phosphor sheet formed on the same plane above the blue phosphor sheet and including a plurality of red phosphor layers, green phosphor layers, and transparent layers to which blue light generated by the blue phosphor sheet is transmitted.

2. The backlight unit of claim 1, further comprising:

a reflective layer formed at the edge regions of the plurality of red phosphor layers, green phosphor layers, and transparent layers, wherein the reflective layer is formed on the same plane as the multi-color phosphor sheet or between the blue phosphor sheet and the multi-color phosphor sheet.

3. The backlight unit of claim 1, wherein the multi-color phosphor sheet further includes a plurality of yellow phosphor layers transmitting the light transmitted through the blue phosphor sheet.

4. A backlight unit, comprising:

a blue light source generating blue light;

a light guide plate into which the blue light is inputted;

a multi-color phosphor sheet formed on the same plane above the light guide plate and including a plurality of red phosphor layers, green phosphor layers, and transparent layer to which the blue light is transmitted; and a reflective layer formed at the edge regions of the plurality of red phosphor layers, green phosphor layers, and transparent layers, and adapted to reflect light towards a bottom of the light guide plate, wherein the reflective layer is formed on the same plane as the multi-color phosphor sheet or between the light guide plate and the multi-color phosphor sheet.

5. The backlight unit of claim 4, wherein the multi-color phosphor sheet further includes a plurality of yellow phosphor layers to which the blue light is transmitted.

6. A liquid crystal display, comprising:

a backlight unit generating red light, green light, and blue light and a liquid crystal panel displaying color images by controlling the light amount of the red light, the green light, and the blue light generated in the backlight unit, wherein the backlight unit includes a white light source generating white light; a light guide plate into which the white light is inputted; a blue phosphor sheet formed above the light guide plate; and a multi-color phosphor sheet formed on the same plane above the blue phosphor sheet and including a plurality of red phosphor layers, green phosphor layers, and transparent layers which receive blue light generated by the blue phosphor sheet.

7. The liquid crystal display of claim 6, wherein the backlight unit further includes a reflective layer formed at the edge regions of the plurality of red phosphor layers, green phosphor layers, and transparent layers and the reflective layer is formed on the same plane as the multi-color phosphor sheet or between the blue phosphor sheet and the multi-color phosphor sheet.

8. The liquid crystal display of claim 6, wherein red subpixels, green subpixels, and blue subpixels corresponding to the areas where the red light, the green light, and the blue light generated in the backlight unit are inputted are formed in the liquid crystal panel.

9. The liquid crystal display of claim 8, wherein the liquid crystal panel includes an upper glass substrate; a lower glass substrate; and a liquid crystal layer formed between the upper and lower glass substrates and a color filter layer is not formed on the upper glass substrate.

10. A liquid crystal display, comprising:

a backlight unit generating red light, green light, and blue light, and including a blue light source generating blue light; a light guide plate into which the blue light is inputted; and a multi-color phosphor sheet formed on a same plane above the light guide plate and including a plurality of red phosphor layers, green phosphor layers, and transparent layers to which the blue light is trasnmitted;

a liquid crystal panel displaying color images by controlling the light amount of the red light, the green light, and the blue light generated in the backlight unit; and a reflective layer formed at the edge regions of the plurality of red phosphor layers, green phosphor layers, and transparent layers, and adapted to reflect light towards a bottom of the light guide plate, wherein the reflective layer is formed on the same plane as the multi-color phosphor sheet or between the light guide plate and the multi-color phosphor sheet.

11. The liquid crystal display of claim 10, wherein red subpixels, green subpixels, and blue subpixels corresponding to the areas where the red light, the green light, and the blue light generated in the backlight unit are inputted are formed in the liquid crystal panel.

12. The liquid crystal display of claim 11, wherein the liquid crystal panel includes an upper glass substrate; a lower glass substrate; and a liquid crystal layer formed between the upper and lower glass substrates and a color filter layer is not formed on the upper glass substrate.

* * * * *